United States Patent [19]

Heald et al.

[11] 4,142,749

[45] Mar. 6, 1979

[54] LATCH MECHANISMS FOR POOL GATES

[75] Inventors: Harold W. Heald, Kenthurst; John W. Norcott, Wentworthville, both of Australia

[73] Assignee: Boral Cyclone Limited, South Melbourne, Australia

[21] Appl. No.: 827,531

[22] Filed: Aug. 24, 1977

[51] Int. Cl.[2] ..... E05C 1/06

[52] U.S. Cl. ..... 292/189; 292/130

[58] Field of Search ..... 292/130, 131, 132, 133, 292/134, 135, 136, 183, 184, 189, 336.3, 8, 146, 147, 148, 149, 335, 42, 162, 174, 150

[56] References Cited

U.S. PATENT DOCUMENTS

| | | | |
|---|---|---|---|
| 727,494 | 5/1903 | Thompson | 292/189 |
| 854,193 | 5/1907 | Betts | 292/189 |
| 1,671,328 | 5/1928 | Sturm et al. | 292/162 |
| 2,641,494 | 6/1953 | Burris | 292/189 |
| 3,953,064 | 4/1976 | McHenry | 292/184 |

*Primary Examiner*—J. Franklin Foss

*Attorney, Agent, or Firm*—Ladas, Parry, Von Gehr, Goldsmith & Deschamps

[57] ABSTRACT

A retaining mechanism locatable in a gate post and having a striker to be attached to a gate, and a latch to releasably retain the striker within the gate post, the latch being movable to a position to release the striker by the manipulation of a release button located beyond the reach of small children.

2 Claims, 9 Drawing Figures

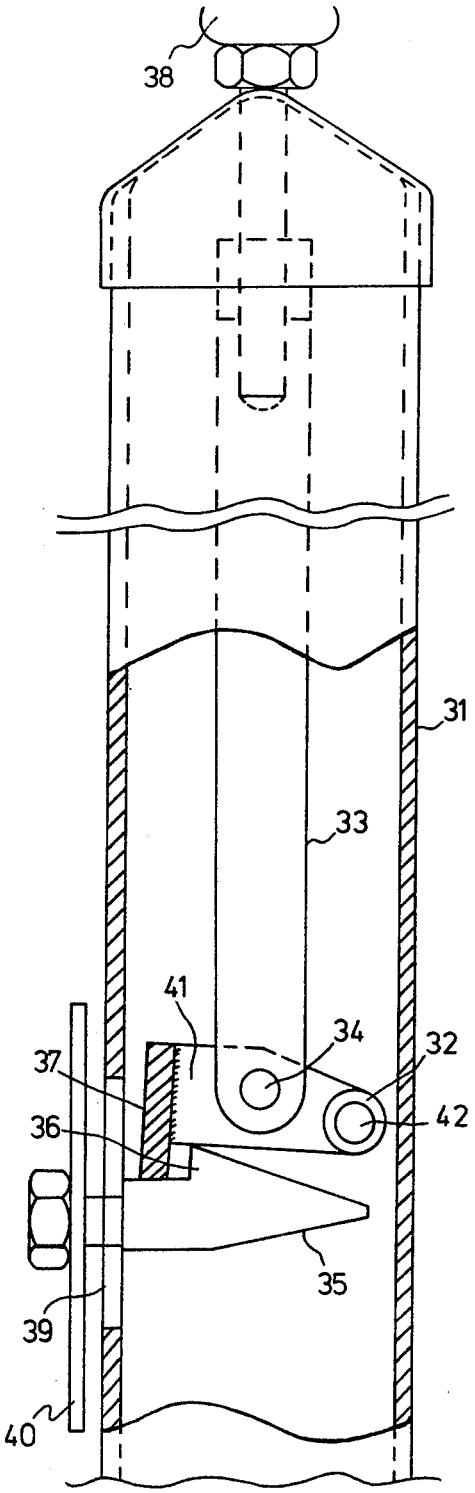
FIG. 3
FIG. 4
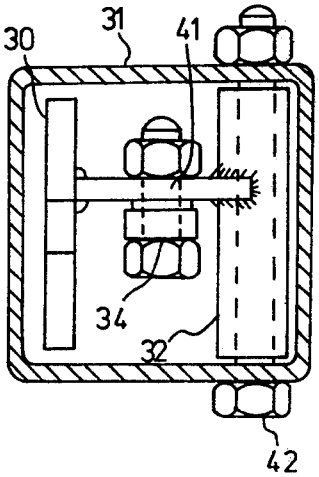

LATCH MECHANISMS FOR POOL GATES

The present invention relates to retaining mechanisms and more particularly but not exclusively to retaining mechanisms for pool gates.

Due to the alarming increase in the number of children drowning in domestic pools it is apparent that a retaining mechanism is needed for pool gates which will retain the gates in a closed position despite the efforts of children to open it. To meet this need applicant has devised a retaining mechanism which is located within the gate post of a gate member to thereby shield the device from manipulation by children.

Still further the present invention provides a retaining mechanism which will only release the gate upon the manipulation of a release button located well out of reach of small children by being placed at, or adjacent the top of the gate post or a gate member.

In general form the present invention is a retaining mechanism comprising in combination a striker to be attached to a gate or gate post, a latch to be located respectively within the gate post or a gate member, said latch being adapted to engage said striker to releasably retain the gate stationary with respect to the gate post, said latch comprising a movable striker engaging member having projection means to engage the striker to retain the striker stationary with respect to the latch, release means including an upwardly extending member attached at one end to said movable member to raise said member enabling the release of said striker from within said latch, the other end of said elongated member being located outside the gate post or said gate member and remote from said latch, and passage means in the gate post or gate member containing the latch to enable said striker to enter said latch.

Further preferred forms of the present invention will now be described by way of example with reference to the accompanying drawings, wherein:

FIG. 3 is a sectioned side elevation of a retaining mechanism having its latch pivotally located within a gate post and engaging a striker fix to a gate.

FIG. 4 is a sectioned plan view of the mechanism of FIG. 3.

Figure 7:
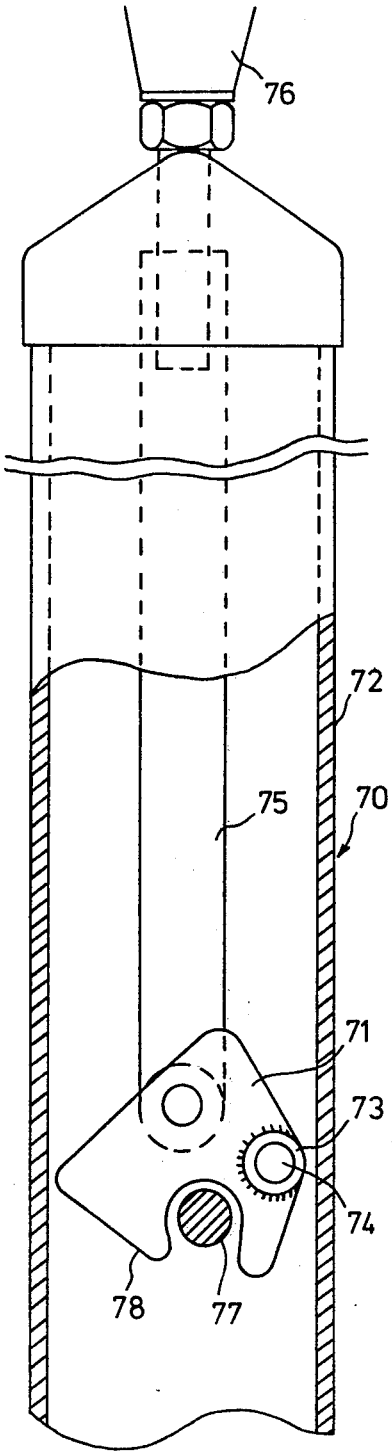
FIG. 7 is a sectioned side elevation of a retaining mechanism having its latch pivotally supported within the gate post.
Figure 9:
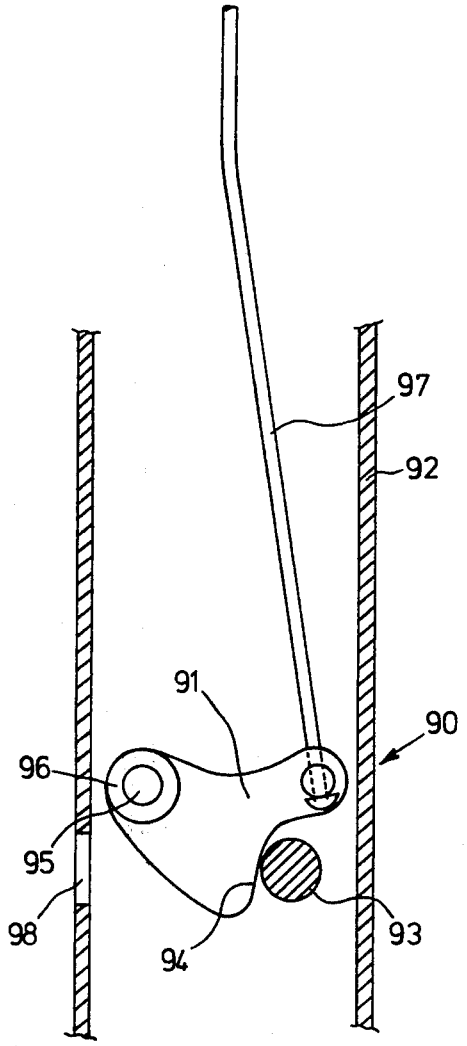

FIG. 9 schematically depicts an alternative latch arrangement to be used in the device of FIG. 7.

Figure 1:
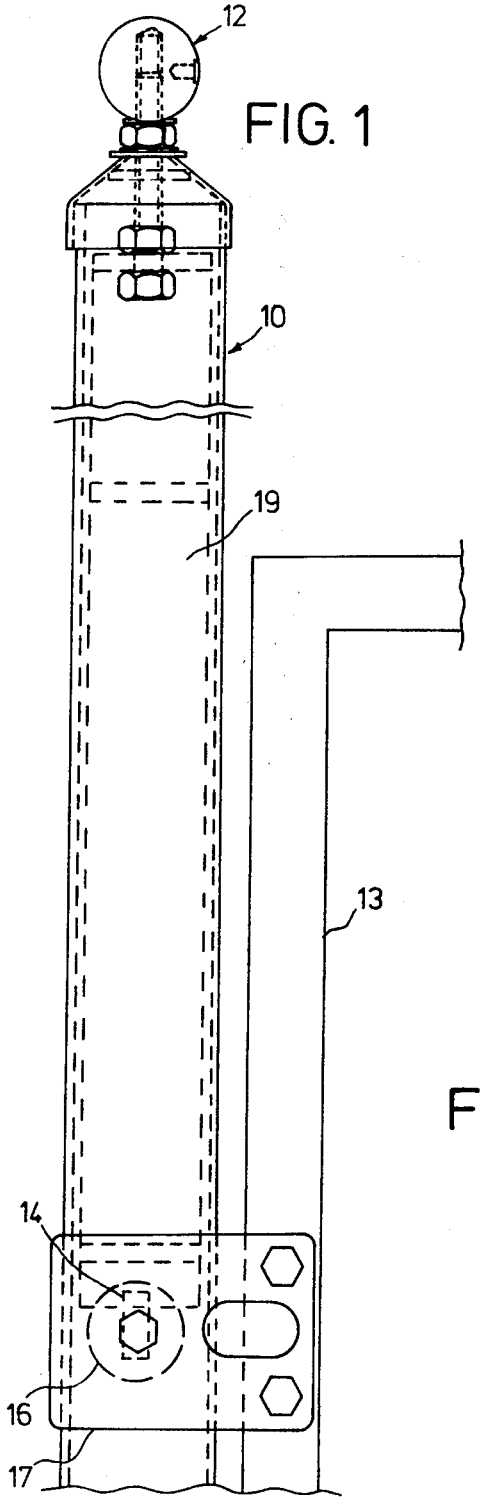
FIG. 1 is a schematic front elevation of a retaining mechanism having its latch vertically slidable located within a gate post and a striker engaged therewith.

The gate 13 of FIG. 1 is depicted in the closed position with the striker 14 attached thereto and engaging the latch 11 so as to retain the gate 13 releasably fixed to the gate post 10. The latch 11 includes an elongated member 19 slidably housed within and guided in its movement by the post 10.

The member 19 is formed from a metal strip bent to a substantially "S" shape so that it is complementary to the inner surfaces of the gate post 10. In this manner the member 19 is restrained to move in a vertical direction only. At its lowest extremity the member 19 is provided with a striker engaging portion 18. The gate post 10 is preferably formed of metal tubing. The striker 14 is released upon upward movement of the member 19 caused by lifting the button 12. The button 12 is located at the top of the post 10 so as to be out of the reach of small children and is bolted to the member 19. The striker 14 is provided with a barb 15 which engages the portion 18 as depicted. The latch 11 is biased to the locked position by gravity.

When the gate 13 is being closed the striker 14 passes through the opening 16 and engages the portion 18 of the latch 11. The inclined face of the barb 15 cause the member 19 to move upward to allow the barb 15 to enter the latch 11. Upon the barb 15 passing portion 18 it falls behind the barb 15 to thereby retain the striker 15 within the gate post 10. To prevent access to the latch 11 via passage 16 there is provided a shield 17 covering the opening 16.

Figure 2:
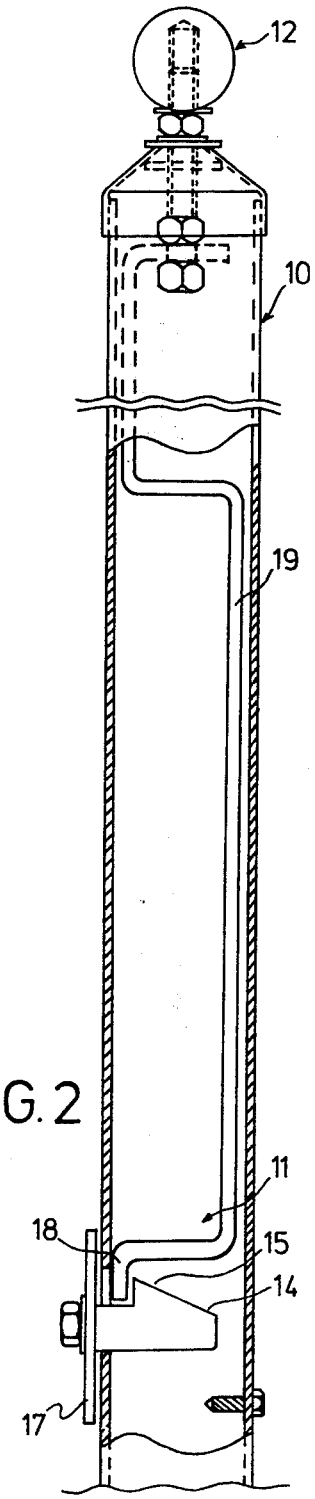
FIG. 2 is a sectioned side elevation of the mechanism of FIG. 1.

In FIGS. 3 and 4 there is depicted an alternative latch arrangement to that of FIGS. 1 and 2. The latch 30 of FIGS. 3 and 4 comprises a pivoted member 41 pivotally attached to the gate post 31 via sleeve 32 and bolt 42, while the rod 33 is pivotally attached to member 41 via pin 34. The bolt 42 also passes through the gate post 31. The striker 35, with barb 36, is depicted in engagement with the striker engaging portion 37 of the member 41 so that the striker 35 is retained within the post 31. To release the striker 35 the button 38 is raised thereby vertically moving rod 33 and causing member 41 to pivot about bolt 42.

When closing the gate, the striker 35 passes through the passage 39 in post 31 and engages the striker engaging portion 37 with the inclined surface of the barb 36. The member 41 is thereby caused to pivot about bolt 42 until the barb 36 has passed portion 37 whereupon the member 41 under the influence of gravity pivots anticlockwise to the locked position depicted wherein the striker engaging portion 37 is in engagement with the barb 15. In a similar manner to the arrangement of FIGS. 1 and 2 there is provided a shield 40 to cover passage 39 and the latch 30 is biased closed by gravity. The latch 50 of FIGS. 5 and 6 comprising a latch engaging member 59 of circular cross-section with its lower edge being formed with tooth-like portions 52. The tooth portions 52 are shaped to engage the fixed pin 53 extending through the gate post 54, so as to prevent clockwise rotation (as viewed in FIG. 5) of the member 59 when in the position depicted. The striker 51 is a circular bar projecting from the gate and adapted to enter ports 55 in member 59.

When closing the gate the striker 51 passes through cutaway portion 56 in gate post 54 and enters one of the ports 55 to engage portion 57 of member 59. As the gate progresses the striker 51 causes the member 59 to rotate anticlockwise thereby also causing it to rise by the interaction of the pin 53 and an inclined surface 58 of one of the toothed portions 52. As the tip of the toothed portions 52 pass over the pin 53 the member 59 falls to the position depicted whereby the striker 51 is locked within the latch 50 since the member 59 cannot be rotated in the opposite direction due to the shape of the toothed portions 52.

Figure 5:
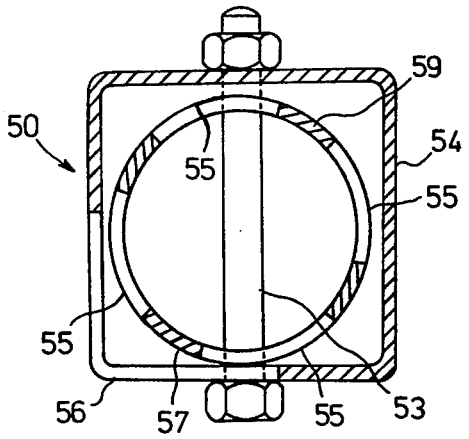
FIG. 5 is a sectioned plan view of the mechanism of FIG. 6.
Figure 6:
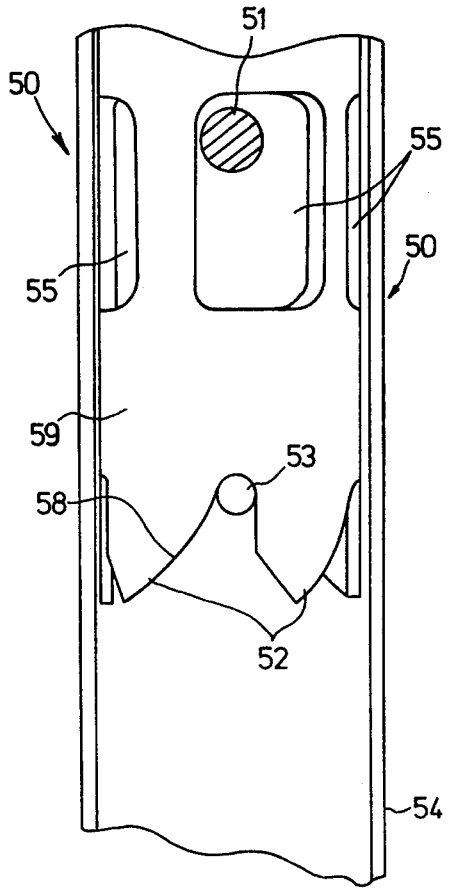
FIG. 6 is a sectioned side elevation of a retaining mechanism slidably and rotatably located within a gate post and engaging a striker.

To release the striker the retaining mechanism of FIGS. 5 and 6 could be provided with a butoon and rod as described with reference to FIGS. 1 to 4. Also the latch 50 is biased closed by gravity.

Figure 8:
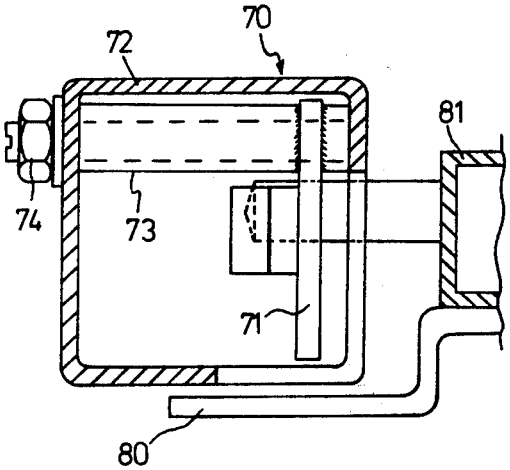
FIG. 8 is a sectioned plan view of the mechanism of FIG. 7.

Turning now to FIGS. 7 and 8 wherein a similar latch to that of FIGS. 3 and 4 is depicted, the latch 70 comprises a pivoted striker engaging member 71 pivotally attached to the gate post 72 by sleeve 73 and bolt 74. The bolt 74 extends through the gate post 72 and is fixed thereto.

Pivotally attached, at its lower extremity, to the member 71 is the rod 75 which extends upwardly to the release button 76. This enables operation of the latch 70 by lifting the release butoon 76, this in turn vertically moves the ord 75 to thereby pivot the member 71 in a clockwise direction. The member 71 is provided with a "U" shaped recess 79 within which the striker bar 77 is located when the gate 81 is closed. The member 71 is further provided with an inclined leading surface 78 which the striker bar 77 engages when entering the latch 70 in order to pivot member 71 to a portion wherein the striker bar 77 may enter recess 79. To release the striker bar the button 76 is raised to again pivot the member 71.

In a similiar manner to that of the latches of FIGS. 1 to 4, the latch 70 is provided with a shield 80 and is biased closed by gravity.

FIG. 9 depicts an alternative latch 90 employing a pivotable striker engaging member 91. The latch 90 is similiar to that of FIGS. 7 and 8 in that the member 91 is pivotally attached to the gate post 92. The striker bar 93 is retained within the latch 90 by projection 94 of the member 91, while the member 91 is pivotally attached to the gate post 92 via bolt 95 and sleeve 96. The numeral 97 designates a wire or rod extending from the member 91 to the release button. The gate post 92 is provided with an extrance passage 98. The passage 98 is similiarly provided with a shield and the latch 90 is biased closed by gravity.

What we claim is:

1. A retaining mechanism comprising a striker to be attached to a gate and having a vertically extending barb on its leading portion, a latch to be located within the gate post, said latch being adapted to engage said barb to releasably retain the gate stationary with respect to the gate post, said latch including a vertically extending movable striker engaging member having at its lower portion projection means to engage the barb to retain the striker stationary with respect to the latch and an upwardly extending portion to be gripped by a user of the gate to raise said member enabling the release of said striker from within said latch, the other end of said movable member being located outside the gate post and remote from said latch, passage means in the gate post containing the latch to enable said striker to enter said latch, wherein said movable member is formed from metal strip and is shaped to engage the inner surfaces of the gate post within which it is to be located so as to be guided thereby to move in a vertical direction only, and said mechanism further includes a shield to be attached to the gate and supporting said striker so that when said striker is located in said latch said shield covers said passage means.

2. The mechanism of claim 1 wherein said striker engaging member is formed from a strip of metal having a substantially rectangular cross section, said strip being bent at several locations about a transverse axis so that said strip has at least two opposite guide surfaces to engage the interior surfaces of a generally rectangular tubular gate post.

* * * * *

UNITED STATES PATENT AND TRADEMARK OFFICE

CERTIFICATE OF CORRECTION

PATENT NO. : 4,142,749

DATED : March 6, 1979

INVENTOR(S) : Harold William Heald and John William Norcott

It is certified that error appears in the above-identified patent and that said Letters Patent are hereby corrected as shown below:

On the cover sheet, left column, between ICIREPAT [22] and ICIREPAT [51] should appear --[30] Foreign Application Priority Data Mar. 1, 1976 Australia.....PC 5066--

Signed and Sealed this

*Fifth* Day of *June 1979*

[SEAL]

*Attest:*

RUTH C. MASON
*Attesting Officer*

DONALD W. BANNER
*Commissioner of Patents and Trademarks*